US010737510B2

(12) United States Patent
Okuda et al.

(10) Patent No.: US 10,737,510 B2
(45) Date of Patent: Aug. 11, 2020

(54) RECORDING METHOD AND RECORDING APPARATUS

(71) Applicant: Seiko Epson Corporation, Tokyo (JP)

(72) Inventors: Ippei Okuda, Shiojiri (JP); Mitsuaki Kosaka, Minowa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/357,655

(22) Filed: Mar. 19, 2019

(65) Prior Publication Data

US 2019/0210380 A1 Jul. 11, 2019

Related U.S. Application Data

(63) Continuation of application No. 15/843,705, filed on Dec. 15, 2017, now Pat. No. 10,279,602, which is a (Continued)

(30) Foreign Application Priority Data

| | | |
|---|---|---|
| Apr. 14, 2015 | (JP) | 2015-082318 |
| Jun. 16, 2015 | (JP) | 2015-120894 |
| Sep. 30, 2015 | (JP) | 2015-192903 |

(51) Int. Cl.

| | |
|---|---|
| ***B41J 2/01*** | (2006.01) |
| ***B41J 11/00*** | (2006.01) |
| ***B41M 5/00*** | (2006.01) |

(52) U.S. Cl.

CPC ..... *B41J 11/0015* (2013.01); *B41M 5/0017* (2013.01)

(58) Field of Classification Search

None

See application file for complete search history.

(56) References Cited

U.S. PATENT DOCUMENTS

| | | | | |
|---|---|---|---|---|
| 2009/0153613 | A1* | 6/2009 | Yamanobe | B41J 2/2114 347/21 |
| 2011/0211013 | A1* | 9/2011 | Matsumoto | C09D 11/101 347/21 |

(Continued)

FOREIGN PATENT DOCUMENTS

| | | | |
|---|---|---|---|
| JP | 2003-326829 | A | 11/2003 |
| JP | 2009-196309 | A | 9/2009 |

(Continued)

*Primary Examiner* — Matthew Luu
*Assistant Examiner* — Tracey M McMillion
(74) *Attorney, Agent, or Firm* — Harness, Dickey & Pierce, P.L.C.

(57) ABSTRACT

A recording method is provided including: discharging and adhering a reaction liquid to an ink non-absorbable or ink low-absorbable recording medium in a form of a droplet, by using an ink jet method, the reaction liquid containing a reagent for aggregating or thickening of a colored ink composition; and adhering a colored ink composition to the recording medium to which the reaction liquid has adhered. The recording medium is heated before adhering the colored ink composition to the recording medium, a period from when adhering of the reaction liquid is ended until adhering of the colored ink composition is started is within 30 seconds, and a surface temperature of the recording medium from the adhering of the reaction liquid to the adhering of the colored ink composition is equal to or lower than 38° C.

15 Claims, 1 Drawing Sheet

Related U.S. Application Data continuation of application No. 15/096,605, filed on Apr. 12, 2016, now Pat. No. 9,873,264.

(56) References Cited

U.S. PATENT DOCUMENTS

| | | | | |
|---|---|---|---|---|
| 2013/0057625 | A1* | 3/2013 | Yamazaki | C09D 11/322 347/100 |
| 2013/0065024 | A1 | 3/2013 | Aruga et al. | |
| 2013/0083118 | A1* | 4/2013 | Ohashi | B41M 5/00 347/20 |
| 2013/0088543 | A1 | 4/2013 | Tsuji et al. | |
| 2013/0222502 | A1 | 8/2013 | Kobayashi | |
| 2014/0132685 | A1* | 5/2014 | Amao | C09D 11/00 347/102 |
| 2015/0091974 | A1* | 4/2015 | Aoyama | B41M 5/0017 347/21 |
| 2015/0174939 | A1* | 6/2015 | Aoyama | C09D 11/322 347/21 |

FOREIGN PATENT DOCUMENTS

| | | | |
|---|---|---|---|
| JP | 2009-226599 | A | 10/2009 |
| JP | 2010-234582 | A | 10/2010 |

* cited by examiner

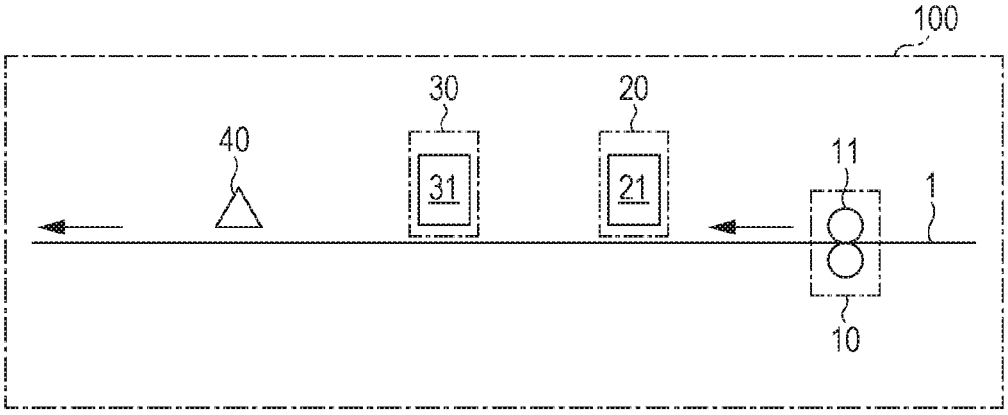
100
30
20
40
31
21
11
1
10

RECORDING METHOD AND RECORDING APPARATUS

CROSS-REFERENCE TO RELATED APPLICATIONS

This application is a continuation of U.S. patent application Ser. No. 15/843,705, filed Dec. 15, 2017, which is a continuation of U.S. patent application Ser. No. 15/096,605, filed Apr. 12, 2016, now U.S. Pat. No. 9,873,264, issued Jan. 23, 2018, and claims priority to Japanese Patent Application No. 2015-082318, filed Apr. 14, 2015, Japanese Patent Application No. 2015-120894, filed Jun. 16, 2015, and Japanese Patent Application No. 2015-192903, filed Sep. 30, 2015, all of which are hereby expressly incorporated by reference herein in their entireties.

BACKGROUND

1. Technical Field

The present invention relates to a recording method, and a recording apparatus for performing the recording method.

2. Related Art

In the related art, an ink jet recording method in which an image is recorded on a recording medium by discharging a fine ink droplet from a nozzle of a recording head of an ink jet recording apparatus has been known. As an ink jet recording ink, an ink in which a colorant such as a dye or a pigment is dissolved or dispersed in an aqueous medium which contains water, an organic solvent, or the like is generally used. The ink jet recording ink is roughly classified into a dye ink and a pigment ink. The dye ink is obtained by mixing a dye as the colorant. The pigment ink is obtained by mixing a pigment as the colorant. Thus far, a dye ink which is excellent in color reproducibility, discharge stability or the like has been widely used. However, a use of an ink jet recording technology is expanding to a digital photographic service, commercial printing, or the like, and thus long-term preservability of a recorded image becomes important, and a pigment ink which is more excellent in water resistance or light resistance, than a dye ink has been used.

However, if recording of a recording medium such as plain paper, coated paper, and art paper is performed by using the pigment ink as the ink jet recording ink, the pigment is permeated into the medium, and thus there is a problem of causing the optical density to be easily insufficient.

To solve the above problem, for example, JP-A-2010-234582 discloses a recording method in which a reaction liquid which is separate from an ink containing a self-dispersion pigment, and contains a pigment cohesive agent, water, and an aqueous organic solvent is prepared, an ink droplet amount is set to be equal to or smaller than 35 pL, and the reaction liquid is superposed on a recording portion which has been formed by using the ink, by using an ink jet method.

JP-A-2003-326829 discloses an ink jet recording method in which a recording surface is coated with a reaction liquid which has a pigment ink aggregation function and a film formation function, and then a pigment ink is discharged so as to record an image, and a film is formed on the recording surface by heating and drying.

In a case where the reaction liquid is adhered to an ink non-absorbable or ink low-absorbable recording medium, since permeating the reaction liquid into the recording medium is difficult, a drying process for drying the reaction liquid is necessary. As the drying process, a method of heating a recording medium, a method of ensuring wait time until adhering of a colored ink composition is performed, or the like is considered. However, in the method of heating a recording medium so as to improve drying properties of the reaction liquid, in a case where heating is excessively performed, nozzles of an ink jet head are easily dried by radiant heat of the heating. Thus, reliability of the ink jet head is degraded. In the method of ensuring the wait time so as to dry the reaction liquid, a printing speed is lowered. As a result, recording productivity may be lowered.

SUMMARY

An advantage of some aspects of the invention is to provide a recording method which can realize recording on an ink non-absorbable or ink low-absorbable recording medium, which is excellent in printing stability and recording productivity, and can record an image which is also excellent in image quality or durability.

The invention can be realized in the following aspects or application examples.

Application Example 1

According to an aspect of the invention, there is provided a recording method which includes discharging and adhering a reaction liquid to an ink non-absorbable or ink low-absorbable recording medium in a form of a droplet, by using an ink jet method, the reaction liquid containing a reagent for aggregating or thickening of a colored ink composition, so as to have a content of 0.1 mol/kg to 0.9 mol/kg, and the reaction liquid having an adhering amount which is set to be equal to or smaller than 1.9 mg/inch$^2$, and adhering a colored ink composition to the recording medium to which the reaction liquid has adhered. A period from when adhering of the reaction liquid is ended until adhering of the colored ink composition is started is within 30 seconds. A surface temperature of the recording medium from the adhering of the reaction liquid to the adhering of the colored ink composition is equal to or lower than 38° C.

According to the recording method of Application Example 1, concentration of the reagent in the reaction liquid used in the reaction liquid adhering process, and an adhering amount of the reaction liquid are controlled, and thus it is possible to realize recording on an ink non-absorbable or ink low-absorbable recording medium, which is excellent in printing stability and productivity, and to record an image which is also excellent in image quality or durability, without excessively performing a drying process on the reaction liquid.

Application Example 2

In the recording method according to Application Example 1, a mass of the reaction liquid per droplet (1 dot) in the reaction liquid adhering process may be equal to or smaller than 10 ng/dot.

Application Example 3

In the recording method according to Application Example 1 or Application Example 2, resolution of droplets in a region of the reaction liquid having the maximum adhering amount in the reaction liquid adhering process may be equal to or greater than 200×200 dpi.

Application Example 4

In the recording method according to any one of Application Examples 1 to 3, an adhering amount of the reagent in the reaction liquid adhering process may be equal to or smaller than 1000 nmol/inch$^2$.

Application Example 5

In the recording method according to any one of Application Examples 1 to 4, a temperature of the recording medium from the reaction liquid adhering process to the colored ink composition adhering process may be from 32° C. to 38° C.

Application Example 6

In the recording method according to any one of Application Examples 1 to 5, the colored ink composition contains a resin, and the resin may include a resin in which a volume of a calcium acetate aqueous solution of 0.085 mol/kg is from 0.1 mL to 7 mL. The volume of the calcium acetate aqueous solution is required for aggregating an aqueous solution (aqueous dispersion liquid) of 3 mL which contains a resin of 1 mass %.

Application Example 7

In the recording method according to any one of Application Examples 1 to 6, regarding a water absorption rate of the recording medium, an absorbed water amount until 30 msec$^{1/2}$ elapses from when contact is started in a Bristow method may be equal to or smaller than 10 mL/m$^2$.

Application Example 8

In the recording method according to any one of Application Examples 1 to 7, at least one selected from a group consisting of a multivalent metal salt and an organic acid may be contained as the reagent.

Application Example 9

In the recording method according to any one of Application Examples 1 to 8, an adhering amount of the reaction liquid may be set to be from 0.3 mg/inch$^2$ to 1.9 mg/inch$^2$ in a recording region in which an adhering amount of the colored ink composition in the colored ink composition adhering process is equal to or greater than 5 mg/inch$^2$.

Application Example 10

According to another aspect of the invention, there is provided a recording apparatus for performing the recording method according to any one of Application Examples 1 to 9.

BRIEF DESCRIPTION OF THE DRAWING

The invention will be described with reference to the accompanying drawings, wherein like numbers reference like elements.

FIGURE is a schematic diagram illustrating an example of an image recording apparatus used for a recording method according to an embodiment.

DESCRIPTION OF EXEMPLARY EMBODIMENTS

Hereinafter, a preferred embodiment will be described. The embodiment which will be described below is used for describing an example of the invention. The invention is not limited to the following embodiment and may include various modification examples conducted in a range without deviating from the gist of the invention.

1. RECORDING METHOD

A recording method according to the embodiment includes a reaction liquid adhering process, and a colored ink composition adhering process. In the reaction liquid adhering process, a reaction liquid is discharged so as to adhere to an ink non-absorbable or ink low-absorbable recording medium in a form of a droplet, by using an ink jet method. The reaction liquid contains a reagent for aggregating or thickening of a colored ink composition, so as to have a content of 0.1 mol/kg to 0.9 mol/kg, and the adhering amount of the reaction liquid is set to be equal to or smaller than 1.9 mg/inch$^2$. In the colored ink composition adhering process, the colored ink composition is adhered to the recording medium to which the reaction liquid has adhered. A period from when adhering of the reaction liquid is ended until adhering of the colored ink composition is started is within 30 seconds. A surface temperature of the recording medium from the reaction liquid adhering process to the colored ink composition adhering process is equal to or lower than 38° C.

In the invention, "an image" indicates a recorded pattern which is formed from a dot group, and includes a text print and a solid image. The "solid image" means a solid image pattern. The solid image pattern is an image in which dots are recorded in all pixels (which is the smallest recording unit region defined by recording resolution), and a recording region of a recording medium is covered with an ink so as to cause the ground of the recording medium not to be viewed.

The recording method according to the embodiment will be described below in detail for each of the processes thereof.

1.1. Reaction Liquid Adhering Process

1.1.1. Description for Processes

In the reaction liquid adhering process, a reaction liquid is discharged so as to adhere to an ink non-absorbable or ink low-absorbable recording medium in a form of a droplet, by using an ink jet method. The reaction liquid contains a reagent for aggregating or thickening of a colored ink composition (which will be described later), so as to have a content of 0.1 mol/kg to 0.9 mol/kg. If the reagent is adhered to the recording region of a recording medium in advance, and the reagent and the colored ink composition are brought into contact with each other, a component (for example, colorant or resin) contained in the colored ink composition, and the reagent react with each other. If the reaction is performed, a state where the colorant or the resin is dispersed in the colored ink composition is disturbed, and thus the colorant or the resin is aggregated or the colored ink composition is thickened. Accordingly, it is considered that it is possible to impede permeation of the colorant into the recording medium, and thus the process is excellent from a point of improvement of image quality of a recorded image.

In the reaction liquid adhering process, the adhering amount of the reaction liquid is set to be equal to or smaller than 1.9 mg/inch$^2$. Thus, it is possible to obtain an excellent image of a record. Particularly, in a case where the adhering amount of the reaction liquid is out from the above range so as to be greater than the above range, a solvent component contained in the reaction liquid which has been adhered to the recording medium is increased. The ink composition is brought into contact with the reaction liquid, and reacts with the reaction liquid in a layer of the reaction liquid in which a solvent is largely contained. Thus, ink droplets landed on the recording medium are aggregated or thickened in a state of a particular shape, and a situation in which ink droplets in an image are viewed in a form of particles appears. Accordingly, it is possible to prevent occurrence of such a situation by causing the adhering amount of the reaction liquid to be in the above range.

In this specification, "an ink non-absorbable or ink low-absorbable recording medium" indicates a recording medium having properties in which any portion of an ink composition is not absorbed or the ink composition is hardly absorbed. Quantitatively, the ink non-absorbable or ink low-absorbable recording medium indicates "a recording medium in which an absorbed water amount until 30 msec$^{1/2}$ elapses from when contact is started in the Bristow method is equal to or smaller than 10 mL/m$^2$". The Bristow method is a method which is used most widely as a measuring method of a liquid absorbing amount for a short term. The Bristow method is employed in Japan Technical Association of the Pulp and Paper Industry (JAPAN TAPPI). Details of a test method are described in "Paper and board-Test of water absorptiveness-Bristow method" Standard No. 51 of "Paper and Pulp test method, JAPAN TAPPI, 2000". An ink absorbable recording medium indicates a recording medium which does not correspond to the ink non-absorbable or ink low-absorbable recording medium.

Examples of the ink non-absorbable recording medium include a plastic film in which an ink absorptive layer is not provided, a medium in which a base such as paper is coated with plastics, a medium to which a plastic film is attached. Examples of plastics referred herein include polyvinyl chloride, polyethylene terephthalate, polycarbonate, polystyrene, polyurethane, polyethylene, and polypropylene.

As the ink low-absorbable recording medium, a recording medium in which a coating layer for accepting an ink is provided on a surface is exemplified. For example, a printing paper such as art paper, coated paper, and matte paper is exemplified as a medium in which paper is provided as a base. In a case where a plastic film is used as a base, a medium in which a surface of polyvinyl chloride, polyethylene terephthalate, polycarbonate, polystyrene, polyurethane, polyethylene, polypropylene, and the like is coated with hydrophilic polymer, a medium in which particles of silica, titanium, and the like are coated along with a binder, and the like are exemplified.

In a case where the reaction liquid is adhered to the an ink non-absorbable or ink low-absorbable recording medium, since permeating the reaction liquid into the recording medium is difficult, a reaction liquid pool in which much water is in the recording region of the recording medium is generated. If the colored ink composition is put into the reaction liquid pool in which much water is present, the colorant or the resin contained in the colored ink composition is aggregated in the reaction liquid pool so as to be particulates. Thus, reversely, image quality may be deteriorated. Accordingly, in a case where the reaction liquid is adhered to an ink non-absorbable or ink low-absorbable recording medium, a drying process for drying the reaction liquid is necessary.

However, the reaction liquid is discharged so as to adhere to a recording medium in a form of droplets, by using the ink jet method, and thus it is confirmed that control for thinly coating the recording medium with the reaction liquid may be performed, and it is possible to ensure image quality of a recorded image with the minimum coating amount by performing thin coating. Thus, since the coating amount of the reaction liquid is small, an amount of moisture adhering to the recording medium is also small. Even when the drying process for drying the reaction liquid is not provided, it is possible to ensure excellent image quality.

As the drying process, a method of heating a recording medium so as to improve a drying property of the reaction liquid, a method of ensuring a long wait time so as to dry the reaction liquid, or the like is considered. However, such a drying process is not required, and thus printing stability and recording productivity are improved. That is, the method of heating a recording medium so as to improve a drying property of the reaction liquid is not performed, or heating is performed as small as required minimum. Thus, it is possible to prevent easy drying of nozzles of an ink jet head by radiant heat of the heating, and to ensure printing stability of the ink jet head. The method of ensuring a long wait time so as to dry the reaction liquid is not performed, and thus a printing speed becomes faster. As a result, recording productivity may be improved.

When the reaction liquid is adhered to a recording medium by using the ink jet method, either of the following forms, that is, a form in which relative scanning of a line-type ink jet head and a recording medium is performed one time by using the head, so as to perform adhering, a form in which adhering is performed by using a multi-path method for the head and the recording medium, which uses a serial type ink jet head, may be provided. However, from a viewpoint of a rapid printing speed, the former is preferable.

When the reaction liquid is adhered to a recording medium by using the ink jet method, the adhering amount of the reaction liquid is in a range which is equal to or smaller than 1.9 mg/inch$^2$. The upper limit value of the adhering amount of the reaction liquid is preferably equal to or smaller than 1.8 mg/inch$^2$, more preferably equal to or smaller than 1.5 mg/inch$^2$, and further preferably equal to or smaller than 1.0 mg/inch$^2$. The lower limit value of the adhering amount of the reaction liquid in the above range is preferably equal to or greater than 0.3 mg/inch$^2$, and preferably equal to or greater than 0.4 mg/inch$^2$. If the adhering amount of the reaction liquid in the recording medium is in the above range, particularly even when the drying process is not performed, or in a case where a heating process is performed to the minimum extent of causing a surface temperature of the recording medium to be in a predetermined range, drying of the reaction liquid is not performed or slightly performed. Even when the solvent component contained in the reaction liquid remains on the recording medium, the adhering amount of the solvent component adhering to the recording medium can be relatively small. Thus, it is possible to obtain excellent image quality of a record, and to realize recording on the recording medium, which is excellent in the printing stability and the recording productivity. Particularly, in a case where recording on an ink non-absorbable or ink low-absorbable recording medium is performed, the above effects are useful. Since the reagent having a required and sufficient amount adheres to the recording region of the recording medium, it is possible to record an image which is excellent in the image quality or the durability. In addition, it is possible to prevent the following occurrences. That is, in a case where the maximum adhering amount of the reaction liquid is equal to or greater than 0.3 mg/inch$^2$, the reagent adhering to the recording medium is insufficient. In addition, the reaction liquid is permeated into the recording medium, and thus, the reagent hardly remains on the surface of the recording medium in the recording region. Accordingly, even when the colored ink composition is adhered to the recording region of the recording medium, causing a reaction is difficult, and obtaining an image which is excellent in the image quality is difficult. Meanwhile, in a case where the maximum adhering amount of the reaction liquid is greater than 1.9 mg/inch$^2$, an amount of the solvent in the reaction liquid adhering to the recording region of the recording medium is large, and a reaction liquid pool is generated. Thus, a need for performing the drying process occurs. In a case where the drying process is performed, realization of the above-described recording which is excellent in printing stability and recording productivity is impossible.

The adhering amount of the colored ink composition in the colored ink composition adhering process is in a region of 5 mg/inch$^2$ or more, and preferably in a range of 5 mg/inch$^2$ to 16 mg/inch$^2$, and the adhering amount of the reaction liquid in the reaction liquid adhering process is set to be from 0.3 mg/inch$^2$ to 1.9 mg/inch$^2$, the above ranges are preferable from a point of causing the image quality, the printing stability, and the recording productivity to become more excellent. In the above case, the adhering amount of the colored ink composition in the colored ink composition adhering process is set to be in a range of 5 mg/inch$^2$ to 13 mg/inch$^2$, and this range is more preferable from the above point. The adhering amount of the colored ink composition is more preferably set to be in a range of 5 mg/inch$^2$ to 10 mg/inch$^2$. In this case, the adhering amount of the colored ink composition tends to be small, and solid printing unevenness or bleeding tends not to occur in a region in which the adhering amount of the colored ink composition is smaller than 5 mg/inch$^2$. In the region, the adhering amount of the reaction liquid is not limited as long as the adhering amount of the reaction liquid is equal to or smaller than 1.9 mg/inch$^2$.

Here, in a case where the recording region in which recording is performed includes a region in which the adhering amount of the reaction liquid is different from other recording regions, in the recording method, the adhering amount of the reaction liquid in the reaction liquid adhering process corresponds to the adhering amount of the reaction liquid in some regions in which the adhering amount is the same as each other. Similarly, in a case where, the recording region in which recording is performed includes a region in which the adhering amount of the colored ink composition is different from other recording regions, in the recording method, the adhering amount of the colored ink composition in the colored ink composition adhering process corresponds to the adhering amount of the colored ink composition in some regions in which the adhering amount is the same as each other.

In the recording region of the recording medium, the maximum adhering amount of the reagent contained in the reaction liquid is preferably set to be equal to or smaller than 1000 nmol/inch$^2$, and more preferably set to be from 90 nmol/inch$^2$ to 1000 nmol/inch$^2$. The upper limit value of the maximum adhering amount of the reagent is preferably equal to or smaller than 700 nmol/inch$^2$, more preferably equal to or smaller than 550 nmol/inch$^2$, further preferably equal to or smaller than 490 nmol/inch$^2$, further more preferably equal to or smaller than 400 nmol/inch$^2$, and particularly preferably equal to or smaller than 300 nmol/inch$^2$. The lower limit value thereof is preferably equal to or greater than 100 nmol/inch$^2$. If the maximum adhering amount of the reagent is in the above range, since the reagent having a required and sufficient amount adheres to the recording region of the recording medium, it is possible to record an image which is excellent in image quality or durability. In a case where the minimum adhering amount of the reaction liquid in the recording region is also in the above range, the above-described effects are more shown, and thus the case is preferable. A case where the maximum adhering amount and the minimum adhering amount of the adhering amount of the reagent are in the above range, that is, corresponds to a case where the adhering amount of the reagent contained in the reaction liquid, in the recording region of the recording medium is in the above range. Thus, it is preferable that the adhering amount of the reagent contained in the reaction liquid, in the recording region of the recording medium is in the above range.

When the reaction liquid is adhered to a recording medium by using the ink jet method, it is preferable that the resolution of droplets in a region of the maximum adhering amount of the reaction liquid is equal to or greater than 200×200 dpi. The lower limit value of the resolution is preferably equal to or greater than 300×300 dpi, more preferably equal to or greater than 360×360 dpi, and particularly preferably equal to or greater than 600×600 dpi. The upper limit value of the resolution is not particularly limited, but may be 2000×2000 dpi. The resolution of droplets in the region of the maximum adhering amount of the reaction liquid is in the above range, and thus it is possible to cause the reagent to uniformly adhere to the recording region of the recording medium, and to improve the drying property of the reaction liquid. Thus, the above ranges are preferable.

When the reaction liquid is adhered to a recording medium by using the ink jet method, it is preferable that the mass of the reaction liquid per droplet (1 dot) is equal to or smaller than 20 ng/dot. The upper limit value of the mass of the reaction liquid per droplet is preferably equal to or smaller than 10 ng/dot, more preferably equal to or smaller than 7 ng/dot, further preferably equal to or smaller than 5 ng/dot, and particularly preferably equal to or smaller than 3 ng/dot. The lower limit value of the mass of the reaction liquid per droplet is preferably equal to or greater than 0.5 ng/dot, and particularly preferably equal to or greater than 1 ng/dot. The mass of the reaction liquid per droplet is in the above range, and thus it is possible to cause the reagent to uniformly adhere to the recording region of the recording medium, and to improve the drying property of the reaction liquid. Thus, the above ranges are preferable.

In order to improve wettability of the reaction liquid for the recording medium before the reaction liquid adhering process, a surface modification process of performing surface modification on the recording medium may be performed. For example, the surface modification is performed so as to cause the wet tension index of the surface of an ink non-absorbable or ink low-absorbable recording medium to be equal to or greater than 40 mN/m. Thus, it is possible to improve wet spreadability of the reaction liquid and to cause the reaction liquid to uniformly adhere to the recording medium. Here, the "wet tension index" is an index of wet tension measured based on "Plastics-Film and Sheeting-Determination of Wetting Tension (JIS K6768:1999).

Such a surface modification process is not particularly limited. For example, a corona treatment, an atmospheric pressure plasma treatment, a flame treatment, an ultraviolet radiation treatment, a solvent treatment, an adhering treatment of a resin liquid (for example, a primer treatment), and the like are exemplified. These treatment methods may be performed by using a well-known apparatus.

1.1.2. Reaction Liquid

Next, a reaction liquid used in the reaction liquid adhering process will be described. The reaction liquid used in the embodiment contains a reagent for aggregation or thickening of the colored ink composition (which will be described later), and other components. Components contained in the reaction liquid which is used in the embodiment, and components which may be contained will be described below in detail.

Reagent

The reaction liquid used in the embodiment contains a reagent which reacts with a component (for example, colorant or resin) contained in the colored ink composition so as to cause aggregation or thickening. Examples of the reagent include a multivalent metal salt, organic acid, and a cationic compound (cationic resin, cationic surfactant, and the like). The reagent may be singly used or used in combination of two or more types. Among the reagents, from a viewpoint of excellent reactivity with the resin contained in the colored ink composition, at least one reagent selected from a group is preferably used. The group consists of the multivalent metal salt and organic acid.

As the multivalent metal salt, a compound which is configured from a multivalent (bivalent or more) metal ion and an anion bonded to the multivalent metal ion, and is soluble in water may be used. Specific examples of the multivalent metal ion include bivalent metal ions such as $ca^{2+}$, $cu^{2+}$, $Ni^{2+}$, $Mg^{2+}$, $Zn^{2+}$, and $Ba^{2+}$; and trivalent metal ions such as $Al^{3+}$, $Fe^{3+}$, and $Cr^{3+}$. Examples of the anion include $Cl^-$, $I^-$, $Br^-$, $SO_4^{2-}$, $ClO^{3-}$, $NO^{3-}$, $HCOO^-$, and $CH_3COO^-$. Among the multivalent metal salts, from stability of the reaction liquid or the reactivity as the reagent, calcium salts and magnesium salts are preferable.

Specific Examples of the multivalent metal salts include salts of strong acid and alkali, for example, nitrate (calcium nitrate, magnesium nitrate, and the like), sulfates (calcium sulfate, magnesium sulfate, and the like), and hydrochloride salts. Salts of weak acid and alkali, such as formate and acetate may be also used.

Examples of organic acid desirably include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid; derivatives of the above compounds; and salts of the above materials. The organic acid may be singly used or be used in combination of two or more types.

Examples of the cationic resin include a cationic urethane resin, a cationic olefin resin, and a cationic allylamine resin.

As the cationic urethane resin, well-known materials may be appropriately selected and used. As the cationic urethane resin, a commercial product may be used. For example, the following materials may be used: Hydran CP-7010, CP-7020, CP-7030, CP-7040, CP-7050, CP-7060, and CP-7610 (merchandise name, manufactured by DIC Corporation); Superflex 600, 610, 620, 630, 640, and 650 (merchandise name, manufactured by DKS Co., Ltd.); and urethane emulsion WBR-2120C and WBR-2122C (merchandise name, manufactured by Taisei Fine Chemical Co., Ltd.).

The cationic olefin resin has olefin such as ethylene and propylene, as a structure skeleton. As the cationic olefin resin, well-known materials may be appropriately selected and used. The cationic olefin resin may be in an emulsion state of being dispersed in a solvent which includes water, an organic solvent, or the like. As the cationic olefin resin, a commercial product may be used. For example, Arrow Base CB-1200 and CD-1200 (merchandise name, manufactured by Unitika Ltd.) are exemplified.

As the cationic allylamine resin, well-known materials may be appropriately selected and used. Examples of the cationic allylamine resin may include polyallylamine hydrochloride, polyallylamine amide sulfate, allylamine hydrochloride•diallylamine hydrochloride copolymers, allylamine acetate•diallylamine acetate copolymers, allylamine hydrochloride•dimethylallylamine hydrochloride copolymers, allylamine•dimethylallylamine copolymers, polydiallylamine hydrochloride, polymethyl diallyl amine hydrochloride, polymethyl diallyl amine amide sulfate, polymethyl diallyl amine acetate, polydiallyl dimethylammonium chloride, diallylamine acetate•sulfur dioxide copolymer, diallyl methylethyl ammonium ethyl sulfate•sulfur dioxide copolymers, methyl diallyl amine hydrochloride•sulfur dioxide copolymer, diallyl dimethyl ammonium chloride•sulfur dioxide copolymers, and diallyldimethyl ammonium chloride•acrylamide copolymer. As such a cationic allylamine-based resin, a commercial product may be used. For example, the following commercial products may be used: PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (merchandise name, manufactured by Nittobo Medical Co., Ltd.), Hymo Neo-600, Hymoloc Q-101, Q-311, and Q-501, and Hymacs SC-505 and SC-505 (merchandise name, manufactured by Hymo Co., Ltd.).

Examples of the cationic surfactant include primary amine salt-type compounds, secondary amine salt-type compounds, and tertiary amine salt-type compounds, alkyl amine salts, dialkyl amine salts, aliphatic amine salts, benzalkonium salts, quaternary ammonium salts, quaternary alkylammonium salts, alkyl pyridinium salts, sulfonium salts, phosphonium salts, onium salts, and imidazolinium salts. Specific examples of the cationic surfactant include hydrochloride such as laurylamine, Yashiamine, and rosin amine, acetates, lauryl trimethyl ammonium chloride, cetyl trimethyl ammonium chloride, benzyl tributyl ammonium chloride, benzalkonium chloride, dimethyl ethyl lauryl ammonium ethyl sulfate, dimethyl ethyl octyl ammonium ethyl sulfate, trimethyllauryl ammonium hydrochloride, cetyl pyridinium chloride, cetyl pyridinium bromide, dihydroxyethyl lauryl amine, decyl dimethyl benzyl ammonium chloride, dodecyl dimethyl benzyl ammonium chloride, tetradecyl dimethyl ammonium chloride, hexadecyl dimethyl ammonium chloride, and octadecyl dimethyl ammonium chloride.

The content of the reagent contained in the reaction liquid is preferably from 0.1 mol/kg to 0.9 mol/kg, with respect to 1 kg of the reaction liquid. The lower limit value of the content of the reagent is preferably equal to or greater than 0.3 mol/kg. The upper limit value thereof is preferably equal to or smaller than 0.7 mol/kg. If the content of the reagent is in the above range, even when the maximum adhering amount of the reaction liquid by using the ink jet method is small, that is, from 0.3 mg/inch$^2$ to 1.9 mg/inch$^2$, the reagent having a required and sufficient amount adheres to the recording region of the recording medium, and sufficiently reacts with the component in the colored ink composition, so as to cause aggregation or thickening. Thus, print quality (image quality or image durability) of a record tends to become good.

Water

The reaction liquid used in the embodiment preferably uses water as the main solvent. The water is a component which adheres the reaction liquid to the recording region of the recording medium, and then is dried so as to be evaporated and scattered. As the water, pure water or ultra-pure water such as ion exchange water, ultrafiltration water, reverse osmotic water, and distilled water that is, water in which ionic impurities are removed as much as possible is preferable. If water sterilized by ultraviolet ray radiation, addition of hydrogen peroxide, or the like is used, generation of mold or bacteria in a case where the reaction liquid is stored for a long term can be prevented. Thus, such water is desired. The content of the water contained in the reaction liquid may be set to be, for example, equal to or greater than 50 mass %, with respect to the total mass of the reaction liquid.

Organic Solvent

An organic solvent may be added to the reaction liquid used in the embodiment. It is possible to improve wettability of the reaction liquid to the recording medium by adding the organic solvent. As the organic solvent, a solvent similar to an organic solvent exemplified in a colored ink composition (which will be described later) may be used. The content of the organic solvent is not particularly limited. However, the content of the organic solvent may be set to be, for example, from 1 mass % to 40 mass %, with respect to the total mass of the reaction liquid.

Surfactant

A surfactant may be added to the reaction liquid used in the embodiment. It is possible to reduce surface tension of the reaction liquid, and to improve wettability for the recording medium by adding the surfactant. Among surfactants, for example, an acetylene glycol-based surfactant, a silicon-based surfactant, and a fluorine-based surfactant may be preferably used. As a specific example of the surfactant, a surfactant similar to a surfactant exemplified in the colored ink composition (which will be described later) may be used. The content of the surfactant is not particularly limited. However, the content of the surfactant may be set to be, for example, from 0.1 mass % to 1.5 mass %, with respect to the total mass of the reaction liquid.

Other Components

If necessary, a pH adjuster, a corrosion inhibitor•antifungal agent, a rust inhibitor, a chelating agent, and the like may be added to the reaction liquid used in the embodiment.

1.2. Colored Ink Composition Adhering Process 1.2.1. Description for Processes

In the colored ink composition adhering process, a colored ink composition is adhered to the recording region to which the reaction liquid has adhere, after the above-described reaction liquid adhering process. In the colored ink composition adhering process, droplets of the colored ink composition are discharged from nozzles of an ink jet recording head, and are adhered to the above-described recording region of the recording medium, which has the adhered reaction liquid, and thereby an image is recorded in the recording region. Thus, an image formed from the colored ink composition is formed in the recording region of the recording medium. The colored ink composition adhering process may be performed by using various printing methods, in addition to the ink jet method in which the process is performed by discharging droplets of the colored ink composition from nozzles of an ink jet recording head. Examples of the various printing methods include letterpress printing, intaglio printing, lithographic printing, and stencil printing. Among the methods, the ink jet method is preferable from a point of reduction in printing cost, improvement of a printing speed, or reduction in energy consumed by the recording apparatus.

The colored ink composition adhering process is performed within 30 seconds from when the reaction liquid adhering process is ended. That is, a period from when adhering of the reaction liquid is ended until adhering of the colored ink composition is started is within 30 seconds. The upper limit value thereof is preferably equal to or smaller than 25 seconds, more preferably equal to or smaller than 20 seconds, further preferably equal to or smaller than 10 seconds. The lower limit value thereof is equal to or greater than 0 second, preferably equal to or greater than 0.05 seconds, more preferably equal to or greater than 0.1 seconds, further preferably equal to or greater than 0.5 seconds, and particularly preferably equal to or greater than 1 second. The colored ink composition adhering process is performed within 30 seconds from when the reaction liquid adhering process is ended, and thus it is possible to obtain excellent recording productivity. The adhering amount of the reaction liquid by using the ink jet method is set to be equal to or smaller than 1.9 mg/inch$^2$, and thus it is possible to obtain excellent image quality even when the period from when adhering of the reaction liquid is ended until adhering of the colored ink composition is started is in the above range. In addition, it is possible to start adhering of the colored ink composition before the reaction liquid is completely permeated into the recording medium. Thus, since the reagent can react with the component contained in the colored ink composition in the recording region of the recording medium, the image quality or the durability of a recorded image is improved. Since the drying process is not required or is slightly performed, good printing stability or good productivity is obtained.

The surface temperature of the recording medium from the reaction liquid adhering process to the colored ink composition adhering process is equal to or lower than 38° C. The upper limit value of the surface temperature of the recording medium is preferably equal to or lower than 35° C., more preferably equal to or lower than 30° C., and further preferably equal to or lower than 25° C. The lower limit value thereof is not particularly limited. However, the lower limit value is preferably equal to or higher than 0° C., more preferably equal to or higher than 5° C., further preferably equal to or higher than 10° C., and particularly preferably equal to or higher than 15° C. The surface temperature of the recording medium being equal to or lower than 38° C. may refer to a case where a heating process of heating the recording medium is not performed, or a case where heating is performed as much as the required minimum amount so as to set the surface temperature of the recording medium to be in the above range. In the heating process, heat is applied to the recording medium so as to increase the surface temperature. Since the heating process is not performed, or is performed as much as the required minimum amount, and thus drying an ink at nozzles in the ink jet head can be suppressed, therefore, the printing stability becomes good. In a case where the heating process of heating the recording medium is not performed, the printing stability becomes better. Thus, the case is preferable. In a case where the heating process is performed so as to set the surface temperature of the recording medium to be in the above range, image quality can become more excellent with maintaining the printing stability, or the case is useful in obtaining further excellent recording productivity. Thus, the case is preferable. From the above-described point, the surface temperature of the recording medium is preferably equal to or higher than 20° C., more preferably equal to or higher than 25° C., further preferably equal to or higher than 30° C., and particularly preferably equal to or higher than 32° C. The adhering amount of the reaction liquid in the reaction liquid adhering process is set to be equal to or smaller than 1.9 mg/inch$^2$, and thus it is possible to obtain excellent image quality even when the surface temperature of the recording medium is in the above range.

The adhering amount of the colored ink composition to the recording region is preferably equal to or smaller than 16 mg/inch$^2$, more preferably equal to or smaller than 13 mg/inch$^2$, and further preferably equal to or smaller than 10 mg/inch$^2$. The adhering amount thereof is more preferably from 5 mg/inch$^2$ to 10 mg/inch$^2$, and further preferably from 5 mg/inch$^2$ to 8 mg/inch$^2$. If the adhering amount of the colored ink composition to the recording region is in the above range, a relative ratio of the adhering amount of the reagent in the recording region, and the adhering amount of the reactive component contained in the colored ink composition becomes appropriate. Thus, the image quality or the durability of a recorded image can become better and the printing speed can become faster. Accordingly the above range is preferable.

In a recording region in which the adhering amount of the colored ink composition to the recording region is equal to or greater than 5 mg/inch$^2$, and preferably from 5 mg/inch$^2$ to 16 mg/inch$^2$, a case where the adhering amount of the reaction liquid in the reaction liquid adhering process is set to be from 0.3 mg/inch$^2$ to 1.9 mg/inch$^2$ is preferable from a point that the reaction of the colored ink composition can occur sufficiently and the image quality or the durability of a record can become further excellent. In this case, the recording method may include a region in which the amount of the colored ink composition to the recording region is smaller than 5 mg/inch$^2$, in the recording region in which recording is performed. This region is an image region having a pale color, and the like, but is a region in which the amount of the colored ink composition to the recording region is small. Because occurrence of a problem of deteriorating the image quality due to solid printing unevenness, bleeding, or the like tends to be difficult in this region, the adhering amount of the reaction liquid in this region in the reaction liquid adhering process may be equal to or smaller than 1.9 mg/inch$^2$. The lower limit of the adhering amount of the reaction liquid is not limited. Adhering of the reaction liquid may not be performed, and the lower limit of the adhering amount thereof may be smaller than 0.3 mg/inch$^2$. More preferably, the adhering amount of the reaction liquid in the reaction liquid adhering process is set to be from 0.3 mg/inch$^2$ to 1.9 mg/inch$^2$, in a recording region in which the adhering amount of the colored ink composition to the recording region is from 3 mg/inch$^2$ to 16 mg/inch$^2$. Further preferably, the adhering amount of the reaction liquid in the reaction liquid adhering process is set to be from 0.3 mg/inch$^2$ to 1.9 mg/inch$^2$, in a recording region in which the adhering amount of the colored ink composition to the recording region is from 1 mg/inch$^2$ to 16 mg/inch$^2$.

After the colored ink composition adhering process, a drying process in which the colored ink composition which has adhered to the recording region of the recording medium may be provided. In this case, drying is preferably performed to an extent of not feeling stickiness when contact with the colored ink composition adhering to the recording region of the recording medium occurs. The drying process of the colored ink composition may be performed in a manner of air drying or in a manner of drying with heating. A heating method of the colored ink composition is not particularly limited. However, for example, a heat press method, an atmospheric pressure steam method, a high-pressure steam method, a thermo-fix method, and the like are exemplified. As a heat source of the heating, for example, an infrared ray (lamp) is exemplified.

1.2.2. Colored Ink Composition

Next, components contained in the colored ink composition which is used in the colored ink composition adhering process, and components which may be contained will be described below in detail.

Resin

The resin contained in the colored ink composition is a resin in which a volume of a calcium acetate aqueous solution of 0.085 mol/kg is from 0.1 mL to 7 mL (preferably equal to or smaller than 5 mL, more preferably equal to or smaller than 3 mL, further preferably equal to or smaller than 2 mL, and particularly preferably equal to or smaller than 1 mL, and the lower limit value thereof is equal to or greater than 0.5 mL, from a viewpoint of easy acquisition). The volume of the calcium acetate aqueous solution is required for aggregating an aqueous solution containing a resin of 1 mass % or an aqueous dispersion liquid of 3 mL. Because such a resin has high reactivity with the above-described reagent, the resin reacts with the reagent rapidly in the recording region of the recording medium. Thus, the state where the resin is dispersed in the colored ink composition is disturbed, and the colored ink composition is aggregated or thickened. Because the obtained aggregate impedes permeation of the colorant into the recording medium, it is possible to prevent occurrence of landing interference or bleeding of the colored ink composition which will adhere thereafter, and to homogenously draw a line, a fine image, and the like. Thus, it is considered that the resin is excellent from a point of improving the image quality of a recorded image. The resin contained in the colored ink composition, and the reagent react with each other rapidly, and thus it is possible to reduce odor.

Such a resin having high reactivity is not particularly limited. However, it is preferable that (1) an anionic resin in which an anionic functional group is put into a surface is used, (2) a resin in which an acid value is equal to or greater than 5 mgKOH/g (preferably equal to or greater than 20 mgKOH/g, and more preferably equal to or greater than 40 mgKOH/g) is used, or (3) a self-dispersion resin which is not obtained without an emulsifier is used. Here, the "anionic resin" refers to a resin in which the entirety of the resin has negative charges. The "self-dispersion resin" refers to a resin which can be dispersed for itself without a need for a dispersant.

Examples of the material of the resin include an acrylic resin, a urethane resin, a polyolefin resin, a polyester resin, a vinyl acetate copolymer resin, and an ionomer resin.

As a form of the resin, a resin particle (resin emulsion) or a water-soluble resin may be used. However, from a point of the above-described effects, the resin particle (resin emulsion) is preferable.

Among the resins, the anionic resin emulsion having the anionic functional group on the surface thereof is preferable because the anionic resin emulsion can improve the reactivity more (reduce the volume relating to the reaction), and can be bonded to the reagent rapidly by electrostatic interaction. Examples of the anionic functional group include a carboxyl group, a sulfonic acid group, and a phosphoric acid group, and a group derived from the above groups.

In the specification, the "acid value" means an amount (mg) of KOH required for neutralizing a resin solid content of 1 g. The "acid value" may be measured by a method described in JIS K0070, for example, a potential-difference titration method.

From a point of sufficient reaction with the reagent, the lower limit value of the solid content of the resin is preferably equal to or greater than 0.1 mass %, more preferably equal to or greater than 0.3 mass %, and particularly preferably equal to or greater than 0.5 mass %, with respect to the total mass of the colored ink composition. From a point of storage stability or discharge stability of the colored ink composition, the upper limit value thereof is preferably equal to or smaller than 13 mass %, more preferably equal to or smaller than 10 mass %, further preferably equal to or smaller than 7 mass %, and particularly preferably equal to or smaller than 5 mass %.

Colorant

The colored ink composition used in the embodiment contains a colorant. From a viewpoint of easy exhibition of the effects of the invention, a pigment or an acid dye may be preferably used as the colorant.

Among pigments, as an inorganic pigment, for example, carbon black, iron oxide, and titanium oxide are exemplified. Carbon black is not particularly limited. However, examples of carbon black include furnace black, lamp black, acetylene black, and channel black (C.I.Pigment Black 7). Examples of commercial products of carbon black include carbon black No. 2300, and 900, MCF88, No. 20B, No. 33, No. 40, No. 45, and No. 52, MA7, MA8, MA100, and No. 2200B (all the above are merchandise name, manufactured by Mitsubishi Chemical Corporation), Carbon Black FW1, FW2, FW2V, FW18, FW200, S150, S160, and S170, Pritex 35, U, V, and 140U, Special Black 6, 5, 4A, 4, and 250 (all the above are merchandise name, manufactured by Degussa AG), Conductex SC, Raven 1255, 5750, 5250, 5000, 3500, 1255, and 700 (all the above are merchandise name, manufactured by Columbian Carbon Japan Ltd, and Columbian Chemicals, Regal 400R, 330R, and 660R, Mogul L, Monarch 700, 800, 880, 900, 1000, 1100, 1300, and 1400, and Elftex 12 (all the above are merchandise name, manufactured by Cabot Corporation).

Examples of an organic pigment include quinacridone-based pigments, quinacridone quinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, isoindolinone-based pigments, azomethine-based pigments, and azo-based pigments. Specific examples of the organic pigment include the following materials.

Examples of a pigment used in a cyan ink include C.I.Pigment Blue 1, 2, 3, 15, and 15:1, 15:2, 15:3, 15:4, 15:6, 15:34, 16, 18, 22, 60, 65, and 66, C.I.Vat Blue 4, and 60.

Examples of a pigment used in a magenta ink include C.I.Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I.Pigment Violet 19, 23, 32, 33, 36, 38, 43, and 50.

Examples of a pigment used in a yellow ink include C.I.Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213.

As pigments used in inks of other colors, such as a green ink and an orange ink, the conventional well-known pigments are exemplified. The pigment may be singly used or be used in combination of two or more types.

As the acid dye, acid dyes of azos, anthraquinones, pyrazolones, phthalocyanines, xanthenes, indigoids, triphenylmethanes and the like are exemplified. Specific examples of the acid dye include C.I. Acid Yellow 17, 23, 42, 44, 79, and 142, C.I. Acid Red 52, 80, 82, 249, 254, and 289, C.I. Acid Blue 9, 45, and 249, and C.I. Acid Black 1, 2, 24, and 94. The acid dye may be singly used or be used in combination of two or more types.

Water

The colored ink composition used in the embodiment preferably uses water as the main solvent. The water is a component which adheres the colored ink composition to the recording region of the recording medium, and then is dried so as to be evaporated and scattered. As the water, pure water or ultra-pure water such as ion exchange water, ultrafiltration water, reverse osmotic water, and distilled water, that is, water in which ionic impurities are removed as much as possible is preferable. If water sterilized by ultraviolet ray radiation, addition of hydrogen peroxide, or the like is used, generation of mold or bacteria in a case where the colored ink composition is stored for a long term can be prevented. Thus, such water is desired. The content of the water contained in the colored ink composition may be set to be, for example, equal to or greater than 50 mass %, with respect to the total mass of the colored ink composition.

Organic Solvent

An organic solvent may be added to the colored ink composition used in the embodiment. Addition of the organic solvent allows the following function to be applied to the ink: a function of improving wettability of the colored ink composition to the recording medium, a function of improving fixability of a recorded image to the recording medium, or a function of preventing drying of a discharge head and improving discharge stability.

The organic solvent is not particularly limited. Examples of the organic solvent include 1,2-alkane diols, polyhydric alcohols (excluding 1,2-alkane diols), pyrrolidone derivatives, and glycol ethers.

Examples of 1,2-alkane diols include 1,2-propanediol, 1,2-butanediol, 1,2-pentanediol, 1,2-hexanediol, and 1,2-octanediol. 1,2-alkane diols has excellent effects of improving the wettability of the colored ink composition for a recording medium and uniformly wet the recording medium. In a case where 1,2-alkane diols are contained, the content of 1,2-alkane diols may be set to be from 1 mass % to 20 mass %, with respect to the total mass of the colored ink composition.

Examples of polyhydric alcohols (excluding 1,2-alkane diols) include ethylene glycol, diethylene glycol, propylene glycol, dipropylene glycol, 1,3-propanediol, 1,4-butanediol, 1,6-hexanediol, trimethylol propane, glycerine. In a case where polyhydric alcohols are contained, the content of polyhydric alcohols may be set to be from 2 mass % to 30 mass %, with respect to the total mass of the colored ink composition.

Examples of the pyrrolidone derivatives include N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. The pyrrolidone derivatives function as a good solubilizer for the resin.

Examples of glycol ethers include ethylene glycol monoisobutyl ether, ethylene glycol monohexyl ether, ethylene glycol monoisohexyl ether, diethylene glycol monohexyl ether, triethylene glycol monohexyl ether, diethylene glycol monoisohexyl ether, triethylene glycol monoisohexyl ether, ethylene glycol mono isoheptyl ether, diethylene glycol monoisoheptyl ether, triethylene glycol monoisoheptyl ether, ethylene glycol monooctyl ether, ethylene glycol monoisooctyl ether, diethylene glycol monoisooctyl ether, triethylene glycol monoisooctyl ether, ethylene glycol mono-2-ethylhexyl ether, diethylene glycol mono-2-ethylhexyl ether, triethylene glycol mono-2-ethylhexyl ether, diethylene glycol mono-2-ethyl pentyl ether, ethylene glycol mono-2-ethyl pentyl ether, ethylene glycol mono-2-ethylhexyl ether, diethylene glycol mono-2-ethylhexyl ether, ethylene glycol mono-2-methyl pentyl ether, diethylene glycol mono-2-methyl pentyl ether, propylene glycol monobutyl ether, dipropylene glycol monobutyl ether, tripropylene glycol monobutyl ether, propylene glycol monopropyl ether, dipropylene glycol monopropyl ether, and tripropylene glycol monomethyl ether. These glycol ethers may be singly used or two or more thereof may be mixed and used. Glycol ethers may control wettability and the like of the ink composition for a recording medium.

The content of the organic solvent is not particularly limited. However, the content of the organic solvent may be set to be, for example, from 1 mass % to 40 mass %, with respect to the total mass of the colored ink composition.

Surfactant

The colored ink composition according to the embodiment may contain a surfactant. The surfactant has a function of reducing surface tension of an ink and improving wettability for the recording medium. Among surfactants, for example, an acetylene glycol-based surfactant, a silicon-based surfactant, and a fluorine-based surfactant may be preferably used.

The acetylene glycol-based surfactant is not particularly limited. Examples of the acetylene glycol-based surfactant include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (all the above are merchandise name, manufactured by Air Products and Chemicals. Inc.), Olfin B, Y, P, A, STG, SPC, E1004, E1010, PD-001, PD-002W, PD-003, PD-004, EXP.4001, EXP.4036, EXP.4051, AF-103, AF-104, AK-02, SK-14, and AE-3 (all the above are merchandise name, manufactured by Nissin Chemical Industry Co., Ltd.), and Acetylenol E00, E00P, E40, and E100 (all the above are merchandise name, manufactured by Kawaken Fine Chemicals Co., Ltd.).

The silicon-based surfactant is not particularly limited. A polysiloxane compound is preferably exemplified. The polysiloxane compound is not particularly limited, and for example, polyether-modified organosiloxane is exemplified. Examples of commercial products of polyether-modified organosiloxane include BYK-306, BYK-307, BYK-333, BYK-341, BYK-345, BYK-346, and BYK-348 (all the above are merchandise name, manufactured by BYK Corporation), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all the above are merchandise name, manufactured by Shin-Etsu Chemical Co., Ltd.).

As the fluorine-based surfactant, fluorine-modified polymer is preferably used. As a specific example of the fluorine-modified polymer, BYK-340 (manufactured by BYK-Chemie Japan Corporation) is exemplified.

In a case where the surfactant is contained, the content of the surfactant may be set to be from 0.1 mass % to 1.5 mass %, with respect to the total mass of the colored ink composition.

Other Components

The ink composition used in the embodiment may contain a pH adjuster, a corrosion inhibitor•antifungal agent, a rust inhibitor, a chelating agent, and the like, if necessary.

1.3. Physical Properties of Each of Ink Compositions

The reaction liquid and the colored ink composition which are used in the embodiment (also referred to as "ink compositions" in the specification) have surface tension at 20° C., which is preferably from 18 mN/m to 35 mN/m, and more preferably from 20 mN/m to 35 mN/m, from a viewpoint of balance between image quality and reliability as an ink jet recording ink. The surface tension may be measured by using, for example, an automatic surface tension measuring device CBVP-Z (merchandise name, manufactured by Kyowa Interface Science Co., Ltd.), and may be measured by confirming surface tension when a platinum plate is wet with the ink under an environment of 20° C.

From the similar viewpoint, viscosity of each of the ink compositions at 20° C., which are used in the embodiment is preferably from 2 mPa·s to 10 mPa·s, and more preferably from 2 mPa·s to 8 mPa·s. The viscosity may be measured under an environment of 20° C. by using, for example, a viscoelasticity tester MCR-300 (merchandise name, manufactured by Pysica Corporation).

2. RECORDING APPARATUS

An example of an image recording apparatus which can perform the above-described recording method according to the embodiment will be described with reference to the drawings. The image recording apparatus allowed to be used in the recording method according to the embodiment is not limited to the following form.

FIGURE is a schematic diagram illustrating the image recording apparatus which can perform the recording method according to the embodiment. An image recording apparatus 100 includes a transportation unit 10, a reaction liquid adhering unit 20, and a colored ink composition adhering unit 30. The transportation unit 10 transports a recording medium 1. The reaction liquid adhering unit 20 adheres the reaction liquid to the recording region of a recording medium. The colored ink composition adhering unit adheres the colored ink composition to the recording region of the recording medium.

2.1. Transportation Unit

The transportation unit 10 may be configured by a roller 11, for example. The transportation unit 10 may include a plurality of rollers 11. A position at which the transportation unit 10 is provided or the number of transportation units 10 is not limited as long as a recording medium 1 can be transported. The transportation unit 10 may include a paper feeding roll, a paper feeding tray, an ejection roll, an ejection tray, and various platens, for example.

FIGURE illustrates a case where the recording medium 1 is a continuous object. However, even when the recording medium 1 is a single sheet, the transportation unit 10 is appropriately configured and thus such a recording medium may be transported.

2.2. Reaction Liquid Adhering Unit

The reaction liquid adhering unit 20 adheres the reaction liquid to the recording region of the recording medium 1 and applies the reagent contained in the reaction liquid to the recording region. The reaction liquid adhering unit 20 includes an ink jet recording head 21. The ink jet recording head 21 includes nozzles for discharging the reaction liquid. As a method of discharging the reaction liquid from the nozzles of the ink jet recording head 21, for example, the following methods are exemplified. Specifically, the following methods are exemplified: a method (electrostatic attraction method) in which a strong electric field is applied between nozzles and an acceleration electrode which is placed in the front of the nozzles, the reaction liquid of a droplet shape is continuously discharged from the nozzles, and droplets of the reaction liquid are discharged corresponding to a recording information signal when flying in a space between deflection electrodes; a method in which a small pump puts pressure on the reaction liquid, a nozzle is mechanically vibrated by a crystal resonator and the like, and thus droplets of the reaction liquid are forcibly discharged; a method (piezo-method) in which pressure by a piezoelectric element and a recording information signal are simultaneously applied to the reaction liquid, and thus droplets of the reaction liquid are discharged and recording is performed; a method (thermal jet method) in which the resin liquid is foamed by being heated in accordance with a recording information signal by using a minute electrode, and thus droplets of the reaction liquid are discharged and recording is performed. The reaction liquid adhering unit is used in the reaction liquid adhering process of the recording method according to the embodiment.

2.3. Colored Ink Composition Adhering Unit

The colored ink composition adhering unit 30 adheres droplets of the colored ink composition to the recording region to which the reaction liquid has adhered, so as to form a recorded image. The colored ink composition adhering unit 30 includes an ink jet recording head 31. The ink jet recording head 31 includes nozzles for discharging the colored ink composition. A method of discharging the colored ink composition from the nozzles of the ink jet recording head 31 is similar to the method described for the reaction liquid adhering unit 20. The colored ink composition adhering unit 30 is used in the colored ink composition adhering process of the recording method according to the embodiment.

2.4. Ink Jet Recording Head

In the reaction liquid adhering unit 20 and the colored ink composition adhering unit 30 which are described above, any of an ink jet recording apparatus which includes a serial type recording head, and an ink jet recording apparatus which includes a line type recording head may be used.

The ink jet recording apparatus which includes the serial type recording head performs recording by performing scanning (path) of discharging the ink composition a plurality number of times while the recording head is moved relatively to a recording medium. As a specific example of the serial type recording head, a recording head installed in a carriage which moves in a width direction of a recording medium (a direction intersecting with a transporting direction of the recording medium) and discharges droplet on the recording medium by moving the recording head according to the movement of the carriage is exemplified.

The ink jet recording apparatus which includes the line type recording head performs recording by performing scanning (path) of discharging the ink composition one time while the recording head is moved relatively to a recording medium. As a specific example of the line type recording head, a recording head which is formed so as to be wider than the width of a recording medium, and discharges droplet on the recording medium without moving the recording head is exemplified.

2.5. Drying Unit

In the image recording apparatus 100, a drying unit 40 may be provided subsequent to the colored ink composition adhering unit 30. The drying unit 40 is provided, and thus it is possible to rapidly evaporate and scatter a liquid medium to a recording medium from the colored ink composition, and to rapidly form a recorded image. The drying unit 40 is not particularly limited as long as the drying unit is configured to accelerate evaporation and scattering of the liquid medium contained in the colored ink composition. For example, a unit of heating a recording medium, a unit of blowing to the reaction liquid, and a unit of combining the above units are exemplified. Specifically, forced air heating, radiant heating, conductive heating, public wave drying, microwave drying, and the like are preferably used. In a case where a recorded image is dried in a manner of air drying, the image recording apparatus 100 may not include the drying unit 40.

The image recording apparatus 100 may include a unit (not illustrated) of drying the reaction liquid at at least one of a location of the reaction liquid adhering unit and a location of the colored ink composition adhering unit 30. A specific configuration of the drying unit may be similar to the above-described drying unit 40. The drying unit dries the reaction liquid which has adhered to the recording medium, before adhering of the colored ink composition. Even when the drying is performed, the temperature of the recording medium or the period until adhering of the colored ink composition is started is set to be similar to that in the above descriptions.

3. EXAMPLES

The embodiment of the invention will be specifically described below by using examples. However, the embodiment is not limited to only the examples.

3.1. Preparation of Ink Compositions

Preparation of Reaction Liquid

After components were mixed and stirred so as to have a mixing ratio in Table 1, the obtained mixture was filtered by using a membrane filter of 10 μm, and thereby reaction liquids (H1 to H4) were prepared. All numeric values in Table 1 indicate mass %. Ion exchange water was added so as to cause the total mass of each of the reaction liquids to be 100 mass %.

Preparation of Colored Ink Composition

After components were mixed and stirred so as to have a mixing ratio in Table 1, the obtained mixture was filtered by using a membrane filter of 10 and thereby colored ink compositions (C1 to C3) were prepared. All numeric values in Table 1 indicate mass %. Ion exchange water was added so as to cause the total mass of each of the colored ink compositions to be 100 mass %.

Reactivity Property Test of Resin

Mixing and stirring was performed while an aqueous calcium nitrate solution of 0.085 mol/kg was dropped into a resin liquid of 3 mL which contained the resin shown in Table 1 so as to be 1 mass %. It was visually confirmed whether or not sediment was generated in a liquid mixture. The volume of the aqueous calcium nitrate solution of 0.085 mol/kg, which is required for aggregation of the resin is also shown in Table 1.

Composite and Physical Property of Ink Compositions

The composite and physical properties of each ink composition obtained in the above descriptions are shown in the following Table. 1.

TABLE 1

| Composition No. | | Resin reactivity (mL) | Reaction liquid H1 | H2 | H3 | H4 | Colored ink composition C1 | C2 | C3 |
|---|---|---|---|---|---|---|---|---|---|
| Reagent | Calcium nitrate-tetrahydrate | — | 7.1 | 19 | 28.5 | 1.2 | 0 | 0 | 0 |
| Coloring material | Cyan pigment | — | 0 | 0 | 0 | 0 | 4 | 4 | 4 |
| Surfactant | Silicon-based surfactant | — | 0.6 | 0.6 | 0.6 | 0.6 | 0.6 | 0.6 | 0.6 |
| Resin | Polyethylene resin A | 0.5 | 0 | 0 | 0 | 0 | 1 | 0 | 0 |
| | Polyethylene resin B | 5 | 0 | 0 | 0 | 0 | 0 | 1 | 0 |
| | Polyester resin | 9 | 0 | 0 | 0 | 0 | 0 | 0 | 1 |
| Solvent | 1,2-hexane diol | — | 3 | 3 | 3 | 3 | 3 | 3 | 3 |
| | Propylene glycol | — | 19 | 15 | 10 | 19 | 10 | 10 | 10 |
| | Tripropanol amine | — | 0.1 | 0.1 | 0.1 | 0.1 | 0.1 | 0.1 | 0.1 |
| | Water | — | Remaining | Remaining | Remaining | Remaining | Remaining | Remaining | Remaining |
| | Total | — | 100 | 100 | 100 | 100 | 100 | 100 | 100 |
| | Content of reagent (mol/kg) | | 0.30 | 0.80 | 1.21 | 0.05 | — | — | — |

Components which are shown in Table 1 other than the names of compounds are as follows.

Coloring Material

Cyan pigment (C.I.Pigment Blue 15:3)

Surfactant

Silicon-based surfactant (merchandise name "BYK-348", manufactured by BYK-Chemie Japan Corporation)

Resin

Polyethylene resin A (merchandise name "AQUASER507", manufactured by BYK-Chemie Japan Corporation, average particle diameter: 50 nm, Tg: 60° C.)

Polyethylene resin B (merchandise name "AQUASER515", manufactured by BYK-Chemie Japan Corporation, average particle diameter: 50 nm, Tg: 60° C.)

Polyester resin (merchandise name "Ester KT-8701", manufactured by Unitika Ltd., average particle diameter: 50 nm, Tg: 60° C.)

3.2. Recording Method

An apparatus obtained by modifying an ink jet printer PX-G930 (manufactured by Seiko Epson Corporation) was used. As the ink jet head, an ink jet head in which nozzle density of a nozzle line was 600 dpi was used. Interlace recording is performed, and thus the recording resolution may be increased. Each one nozzle line was filled with the reaction liquid, and each another nozzle line was filled with the colored ink composition. A heater was attached to the platen, and thus the temperature of the recording medium during recording could be adjusted. In an example in which the temperature of the recording medium was higher than 30° C., the temperature was adjusted by using the heater. In an example in which the temperature of the recording medium was equal to or lower than 30° C., the room temperature was adjusted so as to adjust the temperature of the recording medium. After recording with the reaction liquid was ended, a predetermined leaving period was provided for the platen. The recording medium was reversely sent, and was transported again. Thus, adhering of the colored ink composition was performed so as to overlap the pattern, and the period (wait time) from when adhering of the reaction liquid was ended until adhering of the colored ink composition was started was adjusted. A test pattern of 15 cm×15 cm for a recording medium was set as a recording region, and recording on the recording region was performed. After adhering of the colored ink composition, a recording medium exiting from the printer was heated at 55° C. for 15 minutes. The temperature of a recording medium during recording corresponds to a temperature of the surface of a recording medium at a position thereof which faces the ink jet head.

Recording Conditions for Reaction Liquid

Control was performed so as to cause the adhering amount of the reaction liquid to be an adhering amount in Table 2 and Table 3, or cause an average recording resolution of an adhering region to be a value in Table 2 and Table 3.

Dot size (liquid amount per discharged droplet): being shown in Table 2 and Table 3.

Recording Conditions for Colored Ink Composition

Recording resolution (density of discharged droplet): 1200×1200 dpi

Ink adhering amount: 6.8 mg/inch$^2$

Recording Medium

Recording medium type 1: recording medium having a water absorption rate of 1 mL/m$^2$ or smaller (merchandise name "PET50A PL Sin", manufactured by Lintec Corporation, non-absorbable (very low-absorbable) PET film).

Recording medium type 2: recording medium having a water absorption rate of 8 mL/m$^2$ (merchandise name "Cast 73", manufactured by Daio Paper Corporation, low-absorbable coated paper).

3.3. Evaluation Test

Image Quality

Regarding a record obtained by using the recording method, image quality was visually confirmed, and was evaluated based on the following evaluation criteria. It was observed whether or not deterioration of the image quality, such as solid printing unevenness or bleeding was viewed or whether or not a situation in which ink droplets were viewed in a particulate form occurs.

Evaluation Criteria

A: there is no unevenness in the pattern. There is no bleeding around the pattern. The image is very good.

B: there is no unevenness in the pattern. There is bleeding around the pattern. The image is good.

C: there is significantly much unevenness in the pattern.

D: ink droplets in the pattern are viewed in a particulate form, and an image is difficult to recognize.

Printing Stability

A state of a nozzle when 10 solid image having a size of A4 were printed by using the ink jet printer PX-G930 was visually confirmed, and was evaluated based on the following evaluation criteria.

Evaluation Criteria

A: falling and bending of dots does not occur. The image quality is very good.

B: falling and bending of dots occurs at some portion (4 nozzles or smaller). The image quality is good.

C: falling and bending of dots occurs (5 nozzles to 8 nozzles).

D: Dots are fallen out and bending of dots occurs (9 nozzles or greater).

Record Durability

Regarding the record obtained by using the above-described recording method, durability was evaluated by using a Gakushin-type color rubbing fastness tester (device name "AB-301", manufactured by TESTER SANGYO CO., Ltd.). Specifically, the recording region in which an image was recorded was rubbed with a friction object having an attached white cotton fabric (based on JIS L 0803). The rubbing was repeated 50 times with a load of 500 g.

Evaluation Criteria

A: contamination of the white cotton fabric is confirmed, but peeling does not occur. The durability is very good.

B: it is confirmed that the white cotton fabric is contaminated, and a portion of an image is peeled off (to an extent of 10%). The durability is good.

C: it is confirmed that an image is peeled off. The durability is poor.

Record Productivity

Recording was performed on 100 recording mediums having a size of A4, by using the recording method. The period from when recording was started until the 100-th recording medium was ejected was measured. If necessary, maintenances such as cleaning, for maintaining performance of the recording apparatus was performed during recording.

Evaluation Criteria

A: the measured period is within 1 hour.

B: the measured period is longer than 1 hour and equal to or shorter than 2 hours.

C: the measured period is longer than 2 hours.

3.4. Evaluation Results

Examples 1 to 13 and Comparative Examples 1 to 8 were performed based on the recording method and the evaluation test. Recording methods and Evaluation results of the examples are shown in the following Tables 2 and 3.

TABLE 2

| | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|
| Used reaction liquid/ colored ink composition | H1 C1 | H2 C1 | H2 C1 | H2 C1 | H1 C2 | H1 C1 | H1 C1 | H1 C1 | H1 C1 | H1 C3 | H1 C1 | H1 C2 |
| Concentration of reagent (mol/kg) | 0.3 — | 0.8 — | 0.8 — | 0.8 — | 0.3 — | 0.3 — | 0.3 — | 0.3 — | 0.3 — | 0.3 — | 0.3 — | 0.3 — |
| Concentration of solid pigment (mass %) | — 4 | — 4 | — 4 | — 4 | — 4 | — 4 | — 4 | — 4 | — 4 | — 4 | — 4 | — 4 |
| Concentration of solid polyethylene resin A (mass %) | — 1 | — 1 | — 1 | — 1 | — — | — 1 | — 1 | — 1 | — 1 | — — | — 1 | — — |
| Concentration of solid polyethylene resin B (mass %) | — — | — — | — — | — — | — 1 | — — | — — | — — | — — | — — | — — | — 1 |
| Concentration of solid polyester resin (mass %) | — — | — — | — — | — — | — — | — — | — — | — — | — — | — 1 | — — | — — |
| Adhering amount of reaction liquid (mg/inch$^2$) | 0.4 | 0.4 | 0.4 | 1.2 | 0.4 | 0.4 | 0.4 | 0.4 | 1.6 | 0.4 | 0.4 | 0.4 |
| Recording resolution of reaction liquid (dpi) | 365 × 365 | 365 × 365 | 365 × 365 | 630 × 630 | 365 × 365 | 365 × 365 | 365 × 365 | 240 × 240 | 730 × 730 | 365 × 365 | 365 × 365 | 365 × 365 |
| Recording medium type | 1 | 1 | 2 | 2 | 1 | 1 | 1 | 1 | 1 | 1 | 1 | 1 |
| Recording medium temperature during recording (° C.) | 25 | 25 | 25 | 25 | 25 | 35 | 25 | 25 | 25 | 25 | 38 | 35 |
| Dot mass of reaction liquid (ng/dot) | 3 | 3 | 3 | 3 | 3 | 3 | 3 | 7 | 3 | 3 | 3 | 3 |
| Wait for printing between reaction liquid and color ink (seconds) | 10 | 10 | 10 | 10 | 10 | 10 | 30 | 10 | 10 | 10 | 10 | 10 |
| Image quality | A | A | B | A | B | A | A | B | B | B | A | A |
| Printing stability | A | A | A | A | A | B | A | A | A | A | C | B |
| Record durability | A | B | A | B | A | A | A | A | B | B | A | A |
| Recording productivyty | A | A | A | A | A | A | B | A | A | A | A | A |

TABLE 3

| | Example 13 | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Used reaction liquid/ colored ink composition | H1 C1 | H3 C1 | H1 C1 | H1 C1 | H1 C1 | H4 C1 | H1 C1 | H1 C1 | H1 C1 |
| Concentration of reagent (mol/kg) | 0.3 — | 1.2 — | 0.3 — | 0.3 — | 0.3 — | 0.05 — | 0.3 — | 0.3 — | 0.3 — |

TABLE 3-continued

| | Example 13 | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Concentration of solid pigment (mass %) | — 4 | — 4 | — 4 | — 4 | — 4 | — 4 | — 4 | — 4 | — 4 |
| Concentration of solid polyethylene resin A (mass %) | — 1 | — 1 | — 1 | — 1 | — 1 | — 1 | — 1 | — 1 | — 1 |
| Concentration of solid polyethylene resin B (mass %) | — — | — — | — — | — — | — — | — — | — — | — — | — — |
| Concentration of solid polyester resin (mass %) | — — | — — | — — | — — | — — | — — | — — | — — | — — |
| Adhering amount of reaction liquid (mg/inch$^2$) | 0.2 | 0.4 | 2.0 | 0.4 | 0.4 | 2.1 | 2.3 | 2.3 | 0.2 |
| Recording resolution of reaction liquid (dpi) | 260 × 260 | 365 × 365 | 820 × 820 | 365 × 365 | 365 × 365 | 400 × 400 | 820 × 820 | 820 × 820 | 260 × 260 |
| Recording medium type | 1 | 1 | 1 | 1 | 1 | 1 | 1 | 1 | 1 |
| Recording medium temperature during recording (° C.) | 25 | 25 | 25 | 45 | 25 | 25 | 40 | 35 | 25 |
| Dot mass of reaction liquid (ng/dot) | 3 | 3 | 3 | 3 | 3 | 13 | 3 | 3 | 3 |
| Wait for printing between reaction liquid and color ink (seconds) | 10 | 10 | 10 | 10 | 60 | 10 | 10 | 40 | 60 |
| Image quality | C | A | D | A | A | D | B | B | C |
| Printing stability | A | B | A | D | A | A | D | B | A |
| Record durability | A | C | C | A | A | A | C | C | A |
| Recording productivity | A | A | A | A | C | A | A | C | C |

According to the recording method in Examples 1 to 13 shown in Table 2, it was confirmed that the concentration of the reagent in the reaction liquid used in the reaction liquid adhering process, and the adhering amount of the reaction liquid were controlled, and thus it was possible to realize recording on an ink non-absorbable or ink low-absorbable recording medium, which was excellent in printing stability and productivity, without excessively performing a drying process on the reaction liquid. In addition, according to the recording method, it was confirmed that it was possible to record a color image which was also excellent in image quality or durability of a recorded image.

In Example 13, since the adhering amount of the reaction liquid was small, that is, 0.2 mg/inch$^2$, an amount of the reagent adhering to the recording region of the recording medium was small, aggregation of the component contained in the colored ink composition insufficiently occurred, and unevenness occurred significantly in a pattern of a solid image. It was predicted that the reason of such a situation was because aggregation of the colored ink occurred insufficiently. The basis of the prediction was that, although not shown in Table 2, even when evaluation was performed similarly to Example 1 except that the reaction liquid adhering process was not performed, the image quality evaluation result was approximate to that of Example 13. However, ink droplets in the pattern were not viewed in a particulate form, and recognition difficulty was not felt.

It was understood that the recording medium was heated while the surface temperature was maintained so as to be equal to or lower than 38° C., and thus it was possible to obtain further excellent image quality and obtain excellent printing stability, based on a comparison of Example 12 and Example 5, or a comparison of Example 11, Example 6, and Example 1.

In Comparative Example 7, the wait time was long and thus the recording productivity was largely damaged. The adhering amount of the cohesive agent adhering to the recording medium was large and the durability of a record was deteriorated.

In Comparative Example 1, since the concentration of the reagent in the reaction liquid is too high, the amount of the reagent adhering to the recording region of the recording medium was too large. It is predicted that, if doing so, a state where a layer of the colored ink composition is placed on a layer of the reagent occurs, and thus the durability of a record is deteriorated.

In Comparative Example 2, since the adhering amount of the reaction liquid was too large, a reaction liquid pool was generated in the recording region of the recording medium, and the ink composition adhered to the recording medium in a state where the solvent component of a large amount in the reaction liquid adhered to the recording medium. Thus, ink droplets landed in the reaction liquid instantly performed the reaction, and had a particulate shape. Thus, a situation in which ink droplet in a pattern in the solid image were viewed in a particulate form appeared. It is predicted that the durability of a record is deteriorated because the reagent is not completely fixed to the recording medium.

In Comparative Example 3, adhering of the colored ink composition was performed in a state where the temperature of the recording medium was adjusted through the heating process, so as to be 45° C. If doing so, the nozzle of the ink jet head was dried by radiant heat, and the printing stability was largely damaged.

In Comparative Example 4, since the wait time from when adhering of the reaction liquid was ended until adhering of the colored ink composition was started was set to 60 seconds, the recording productivity was largely damaged.

In Comparative Example 5, similarly to Comparative Example 2, it is predicted that, since the adhering amount of the reaction liquid was too large, a reaction liquid pool was generated in the recording region of the recording medium, and a situation in which ink droplets in the pattern in a solid image are viewed in a particulate form occurs. However, the adhering amount of the cohesive agent adhering to the recording medium was smaller than that in Comparative Example 2, and the durability of a record became better than that in Comparative Example 2.

In Comparative Example 6, even when the reaction liquid which had an excessively large adhering amount was dried through the heating process (40° C.), the nozzle was dried and the printing stability was largely damaged. The reaction liquid was insufficiently dried, and thus the durability of a record was deteriorated.

In Comparative Example 7, even when the reaction liquid which had an excessively large adhering amount was dried by causing the wait time to be long, recording productivity was largely damaged. The reaction liquid was insufficiently dried, and thus the durability of a record was deteriorated.

In Comparative Example 8, the wait time was long and the recording productivity was damaged.

The invention is not limited to the above-described embodiment, and various modifications may be applied. For example, the invention includes a configuration (for example, configuration having the same function, the same method, and the same results, or configuration having the same object and the same effects) which is substantially the same as the configuration described in the embodiment. The invention includes a configuration obtained by substituting a component which is not fundamental component in the configuration described in the embodiment. The invention includes a configuration which can exhibit the same advantages effects the same as those of the configuration described in the embodiment, or can achieve the same object. The invention includes a configuration obtained by adding well-known technologies to the configuration described in the embodiment.

What is claimed is:

1. A recording method comprising:

discharging and adhering a reaction liquid to an ink non-absorbable or ink low-absorbable recording medium in a form of a droplet, by using an ink jet method, the reaction liquid containing a reagent for aggregating or thickening of a colored ink composition; and adhering a colored ink composition to the recording medium to which the reaction liquid has adhered;

wherein the recording medium is heated before adhering the colored ink composition to the recording medium, a period from when adhering of the reaction liquid is ended until adhering of the colored ink composition is started is within 30 seconds, and a surface temperature of the recording medium from the adhering of the reaction liquid to the adhering of the colored ink composition is equal to or lower than 38° C., wherein the colored ink composition contains a resin, and the resin includes a resin in which a volume of a calcium acetate aqueous solution of 0.085 mol/kg is from 0.1 mL to 7 mL, and the volume thereof is required for aggregating 3 mL of an aqueous solution that contains 1 mass % of the resin or 3 mL of an aqueous dispersion liquid that contains 1 mass % of the resin.

2. The recording method according to claim 1, wherein a mass of the reaction liquid per droplet (1 dot) in the adhering of the reaction liquid is equal to or smaller than 10 ng/dot.

3. The recording method according to claim 1, wherein resolution of droplets in the adhering of the reaction liquid is equal to or greater than 200×200 dpi.

4. The recording method according to claim 1, wherein a temperature of the recording medium from the adhering of the reaction liquid to the adhering of the colored ink composition is from 32° C. to 38° C.

5. The recording method according to claim 1, wherein regarding a water absorption rate of the recording medium, an absorbed water amount until 30 $msec^{1/2}$ elapses from when contact is started in a Bristow method is equal to or smaller than 10 $mL/m^2$.

6. The recording method according to claim 1, wherein at least one selected from a group consisting of a multivalent metal salt and an organic acid is contained as the reagent.

7. The recording method according to claim 1, wherein a content of the reagent is in the range of 7.1 to 18 mass % with respect to a total mass of the reaction liquid.

8. A recording apparatus which performs the recording method according to claim 1.

9. The recording method according to claim 1, wherein a temperature of the recording medium from the adhering of the reaction liquid to the adhering of the colored ink composition is in the range of 30° C. to 38° C.

10. The recording method according to claim 1, wherein a period from when the adhering of the reaction liquid ends until the adhering of the colored ink composition begins is within 10 seconds.

11. The recording method according to claim 1, wherein the reaction liquid contains an organic solvent, and a content of the organic solvent is in the range of 1 mass % to 40 mass % with respect to a total mass of the reaction liquid.

12. The recording method according to claim 1, wherein the reaction liquid contains an organic solvent, and a content of the organic solvent is in the range of 22.1 mass % to 40 mass % with respect to a total mass of the reaction liquid.

13. The recording method according to claim 1, wherein the colored ink composition contains resin particles, and a solid content of the resin particles is in the range of 0.5 mass % to 13 mass % with respect to a total mass of the colored ink composition.

14. The recording method according to claim 1, wherein the colored ink composition contains an organic solvent, and a content of the organic solvent is in the range of 2 mass % to 30 mass % with respect to a total mass of the colored ink composition.

15. The recording method according to claim 1, wherein the adhering of the colored ink composition to the recording medium is performed using a serial type recording head that is configured to perform a scanning that includes moving the serial type recording head relative to the recording medium and discharging the colored ink composition therefrom, and the scanning is performed a plurality of times.

* * * * *